US010843777B2

(12) United States Patent
McLean

(10) Patent No.: US 10,843,777 B2
(45) Date of Patent: Nov. 24, 2020

(54) SAFETY RELEASE MECHANISM FOR KITE-SURFING

(71) Applicant: Ocean Rodeo Sports Inc., Victoria (CA)

(72) Inventor: Liam Kenneth Maynard McLean, Victoria (CA)

(73) Assignee: OCEAN RODEO SPORTS INC., Victoria (CA)

( * ) Notice: Subject to any disclaimer, the term of this patent is extended or adjusted under 35 U.S.C. 154(b) by 0 days.

(21) Appl. No.: 16/661,104

(22) Filed: Oct. 23, 2019

(65) Prior Publication Data

US 2020/0130788 A1 Apr. 30, 2020

Related U.S. Application Data

(60) Provisional application No. 62/750,568, filed on Oct. 25, 2018.

(51) Int. Cl.
*B63H 8/54* (2020.01)

(52) U.S. Cl.
CPC ..... *B63H 8/54* (2020.02)

(58) Field of Classification Search
CPC ... B63H 8/54; B63H 8/00; B63H 8/10; B63H 8/18
See application file for complete search history.

(56) References Cited

U.S. PATENT DOCUMENTS

| | | | | |
|---|---|---|---|---|
| 4,444,413 | A * | 4/1984 | Richert | A63C 9/0845 280/632 |
| 6,581,879 | B2 | 6/2003 | Bellacera | |
| 6,691,954 | B1 | 2/2004 | Harrington et al. | |
| 6,988,694 | B2 | 1/2006 | Barrs et al. | |
| 2014/0102431 | A1* | 4/2014 | Kennedy | F41B 5/12 124/35.1 |

FOREIGN PATENT DOCUMENTS

| | | |
|---|---|---|
| DE | 20 2010 007 197 U1 | 9/2010 |
| DE | 20 2011 050 423 U1 | 1/2012 |

* cited by examiner

*Primary Examiner* — Stephen P Avila
(74) *Attorney, Agent, or Firm* — Davis & Bujold PLLC; Michael J. Bujold

(57) ABSTRACT

A safety release mechanism for kite surfing with a safety release member by which a kite surfer is attached to the body. A locking element detachably secures an attachment end of the safety release member to the body. A resilient element urges the locking element into the unlocked position, such that upon release for the locking element, the resilient element moves the locking element to the unlocked position thereby resulting in a release of the attachment end of the safety release member, regardless of the orientation of the device, the orientation of the kite, or the available strength of the kite surfer.

6 Claims, 10 Drawing Sheets

SAFETY RELEASE MECHANISM FOR KITE-SURFING

FIELD

There is described a safety release mechanism for kite surfing.

BACKGROUND

Kite surfers are connected to a kite surfing assembly by a safety release mechanism. The safety release mechanisms main purpose is to allow the kite surfer to rapidly separate themselves from the power lines of a kite in the case of emergency. Prior art safety release mechanisms for kite surfing generally have a body with a connection for connecting the body to a kite surfing assembly. The kite surfer is attached to the body with a safety release member. The safety release member has a first end and a second end. The first end is pivotally attached to the body for pivotal movement between an operative position and a release position. A locking element is provided for securing the second end of the safety release member to the body.

It is undesirable if there is a delay in the locking element releasing the safety release mechanism due to the orientation of the device, the orientation of the kite, or the available strength of the kite surfer.

SUMMARY

There is provided a safety release mechanism for kite surfing which includes a body having a connection for connecting the body to a kite surfing assembly. A safety release member is provided by which a kite surfer is attached to the body. The safety release member having an attachment end. A locking element detachably secures the attachment end of the safety release member to the body. The locking element has a locked position and an unlocked position. A release is provided for the locking element, such that the locking element is unable to move from the locked position to the unlocked position until the release is activated. A resilient element urges the locking element into the unlocked position, such that upon activation of the release for the locking element, the resilient element moves the locking element to the unlocked position thereby resulting in release of the attachment end of the safety release member.

The safety release mechanism, as described above, ensures that there is no delay in the movement of the safety release member to the release position caused by a delay in the locking element moving to the unlocked position.

In the detailed description that follows, various embodiments will be described to demonstrate that the resilient element may be a tension based resilient element, a compression based resilient element or a torsion based resilient element.

In the detailed description that follows, various embodiments will be described to demonstrate that different types of locking elements can be used as long as there is a resilient element biasing the locking element into the unlocked position.

Although various release mechanisms can be used for the locking element, the one that is preferred is a cover overlying the locking element. The locking element is unable to move from the locked position to the unlocked position as long as the cover is in position.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
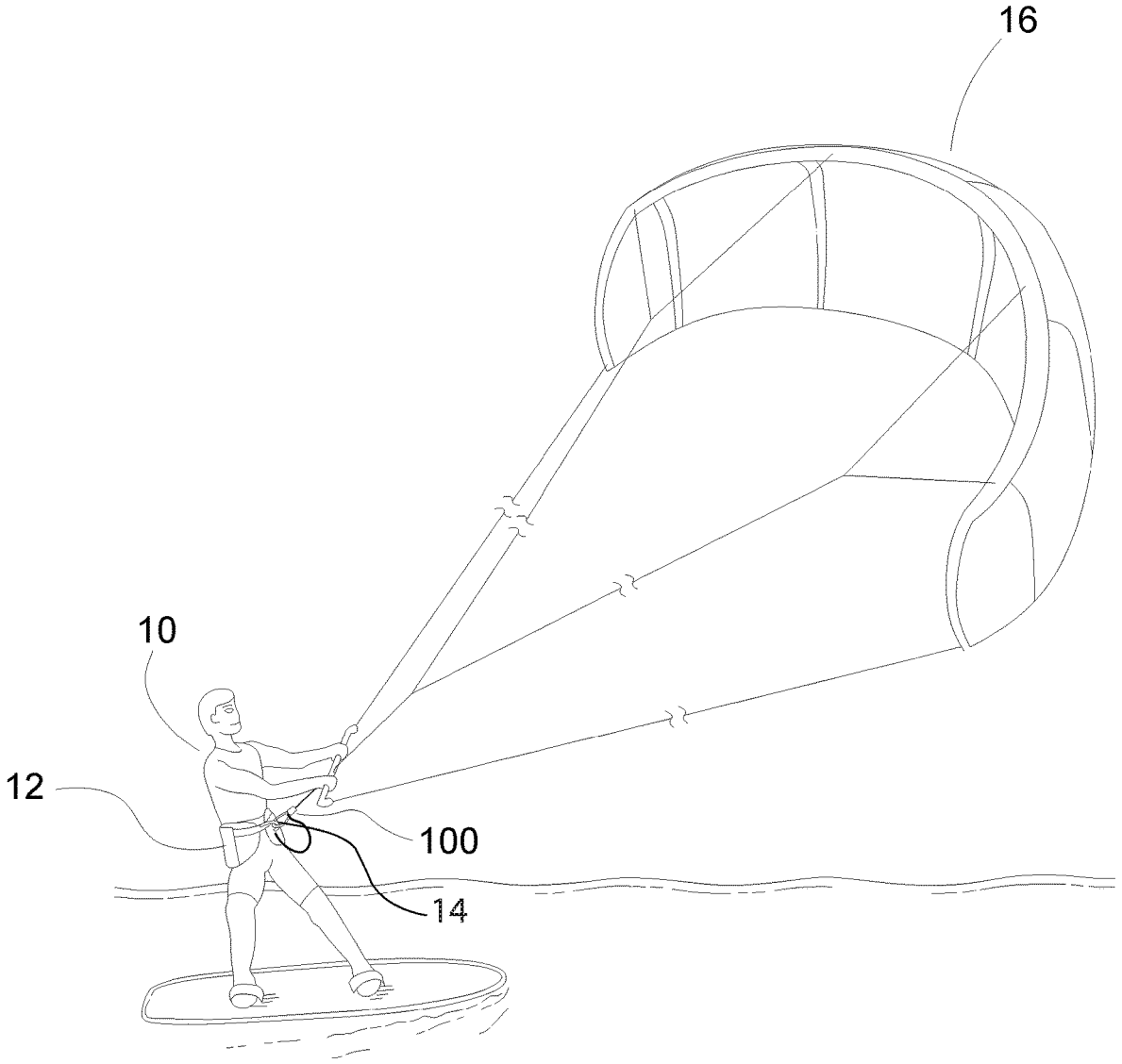
FIG. 1 is a perspective view of a kite surfer attached to a kite surfing assembly with of safety release mechanism.

A first embodiment of safety release mechanism generally identified by reference numeral 100, will now be described with reference to FIG. 1 through FIG. 4B. Variations will then be described. A second embodiment of safety release mechanism generally identified by reference numeral 200, will be described with reference to FIG. 5 and FIG. 6. A third embodiment of safety release mechanism generally identified by reference numeral 300, will be described with reference to FIG. 5 and FIG. 6. A third embodiment of safety release mechanism generally identified by reference numeral 300, will be described with reference to FIG. 7 and FIG. 8. A fourth embodiment of safety release mechanism generally identified by reference numeral 400, will be described with reference to FIG. 9 and FIG. 10.

Structure and Relationship of Parts:

Referring to FIG. 1, each safety release mechanism includes a body 100 having a connection 14 for connecting body 100 to a kite surfing assembly 16. A safety release member is provided by which a harness 12 of a kite surfer 10 is attached to body 100.

Figure 2:
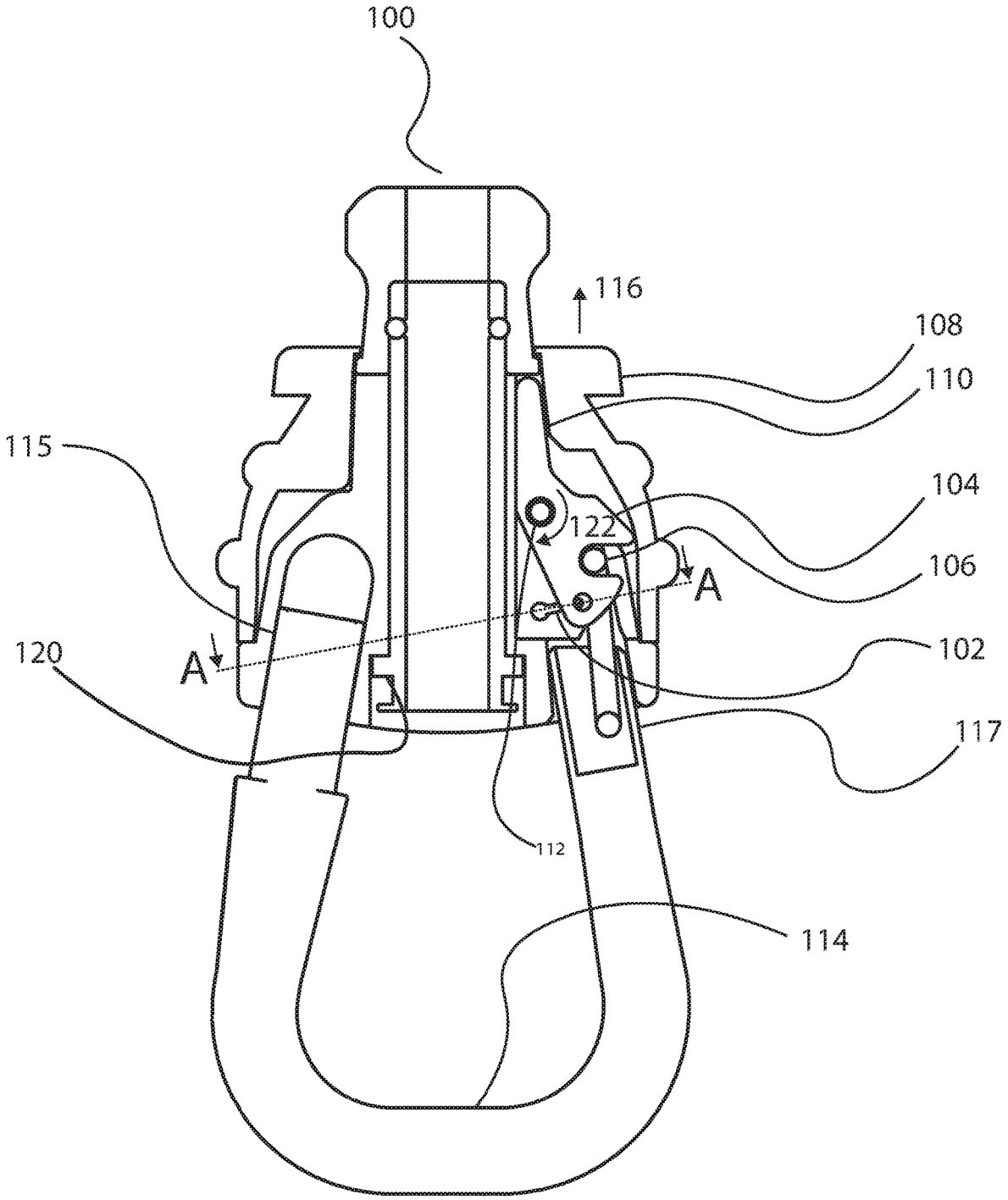
FIG. 2 is a top plan view, in section, of a first embodiment of safety release mechanism, with the locking element in the locked position securing the safety release member to the body of the safety release mechanism.
Figure 3:
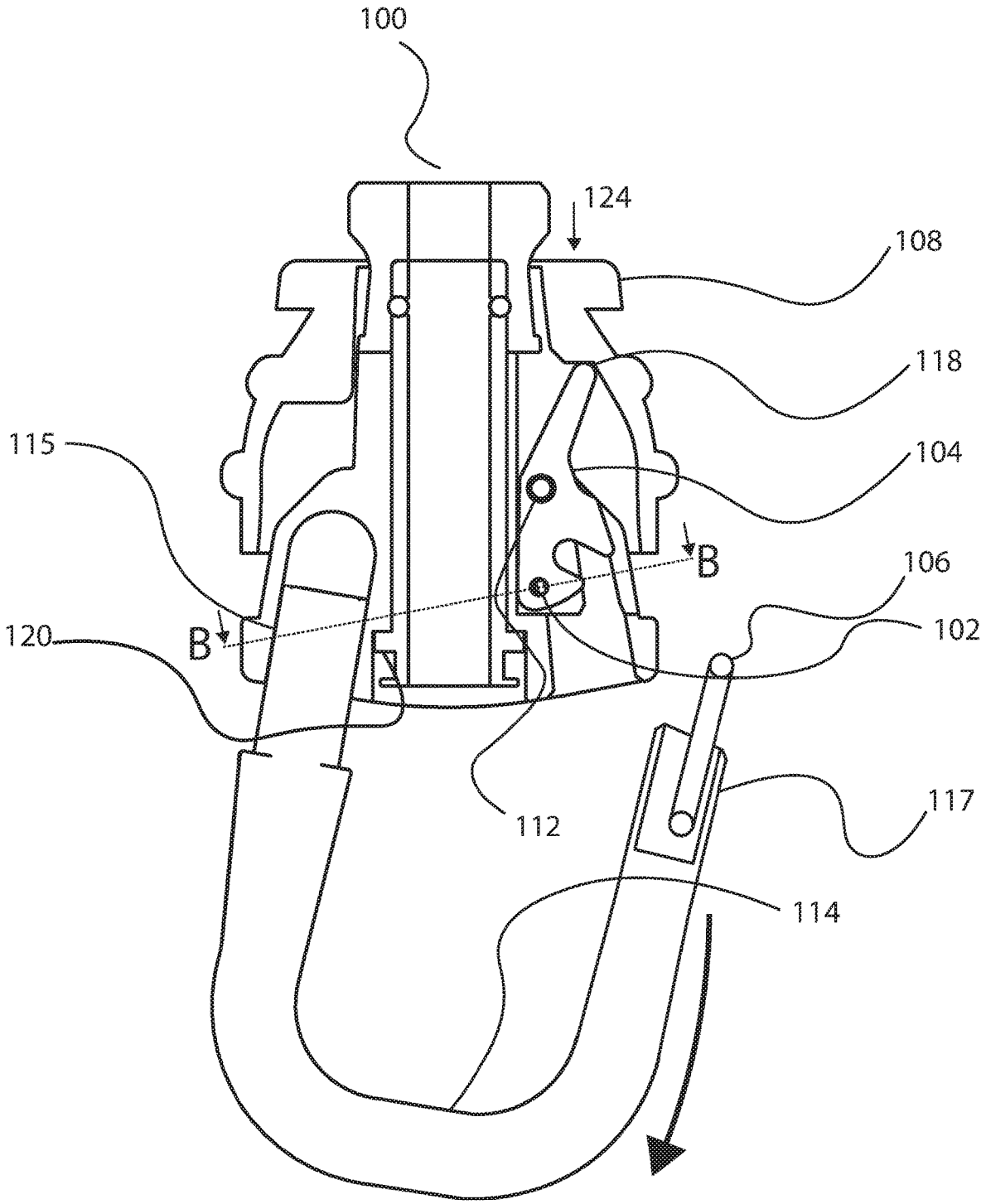
FIG. 3 is a top plan view, in section, of the first embodiment of safety release mechanism shown in FIG. 2, with the locking element in the unlocked position releasing the safety release member.

Referring to FIG. 2 and FIG. 3, safety release member 114 has a first end 115 and an attachment end 117. First end 115 is pivotally attached to body 100 for pivotal movement between an operative position shown in FIG. 2 and a release position shown in FIG. 3. A locking element 104 detachably secures a locking clip 106 positioned at attachment end 117 of safety release member 114 to body 100. Locking element 104 has a locked position as shown in FIG. 2 and an unlocked position as shown in FIG. 3. A release is provided for locking element 104, such that locking element 104 is unable to move from the locked position shown in FIG. 2 to the unlocked position shown in FIG. 3 until the release is activated. In the first embodiment shown in FIG. 2 and FIG. 3, the release is in the form of an actuating retaining cuff 108 that blocks the pivotal path of locking element 104 at point 110. A resilient element urges locking element 104 into the unlocked position. In the first embodiment resilient element is a tension based resilient element 102 that is under tension and is applying a rotational force in direction 122 to locking element 104. In the first embodiment movement of retaining cuff 108 in a direction shown by arrow 116, results in locking element 104 being forced to rotate about pivot point 112 by resilient element 102, ejecting locking clip 106 and resulting in the movement of safety release member 114 to the release position shown in FIG. 3.

There now follows a figure by figure description.

FIG. 1: FIG. 1 shows a kitesurfing rider 10 using the safety device 100 with a kitesurfing kite 16 the user is attached to the safety device at user attachment point 14 using a harness 12.

FIG. 2: FIG. 2 shows a cross section of embodiment 100 of the invention using a tension based resilient element102 in its locked position. Attachment end 117 of safety release member 114 is locked by the locking clip 106 being held in place by the downward pivoting locking element 104 which is unable to rotate, as the actuating retaining cuff 108 blocks its path at point 110. In this position, the tension based resilient element102 is elastically deformed, and is applying a rotational force in direction 122 to the downward pivoting element 104.

The user is attached to the invention at safety release member 114 by an attachment device such as but not limited to a harness using hook, ball, or rope. The kite is attached to the invention by its front lines, at kite attachment point 120.

Once the user actuates the actuating retaining cuff 108 in direction 116 the downward pivoting locking element 104 is forced to rotate about pivot point 112 by the tension based elastic resilient element 102, ejecting the locking clip 106.

FIG. 3: FIG. 3 shows a cross section of embodiment 100 of the invention using a tension based resilient element 102 in its unlocked position.

In the unlocked position, the user's attachment device is no longer attached at the user safety release member 114. And the actuating retaining cuff 108 is locked in its open position by the downward pivoting locking element 104 at point 118. The tension based elastic resilient element 102 is either in an unreformed state, or at a lesser deformed state than in its locked position.

To lock the device again. The locking clip 106 is pressed against the downward pivoting locking element 104 rotating it about pivot point 112. Allowing the actuating retaining cuff 108 to return to the locked position moving in the direction 124. This motion also returns the tension based elastic resilient element 102 to its deformed state.

Figure 4A:
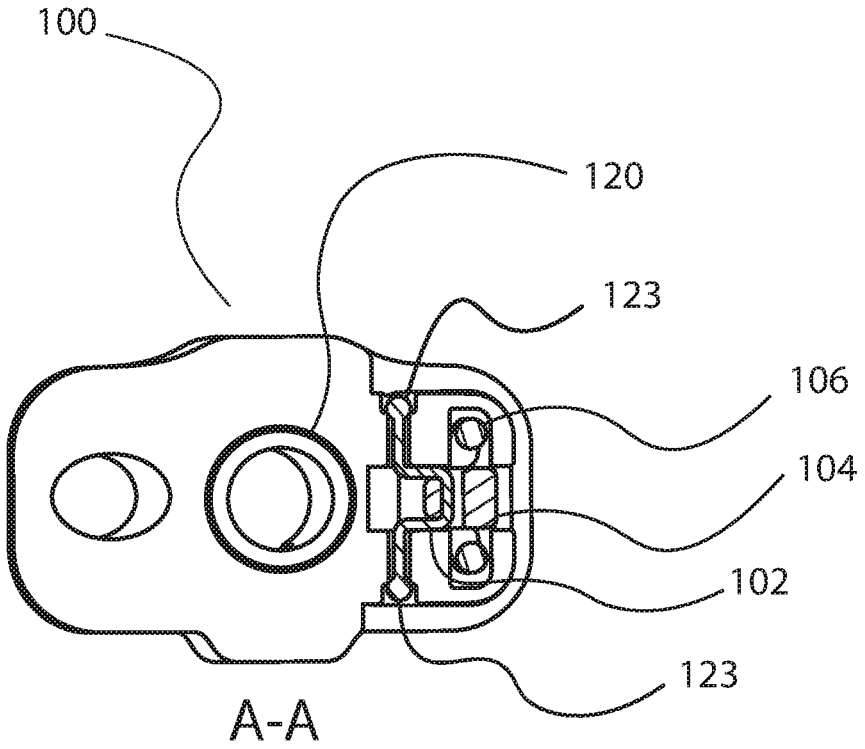
FIG. 4A is a section view taken along section lines A-A of FIG. 2, showing a tension based resilient element when the locking element is in the locked position.

FIG. 4: FIG. 4A shows a cross section of embodiment 100 of the invention taken at section line A-A of FIG. 2 in the locked position.

Figure 4B:
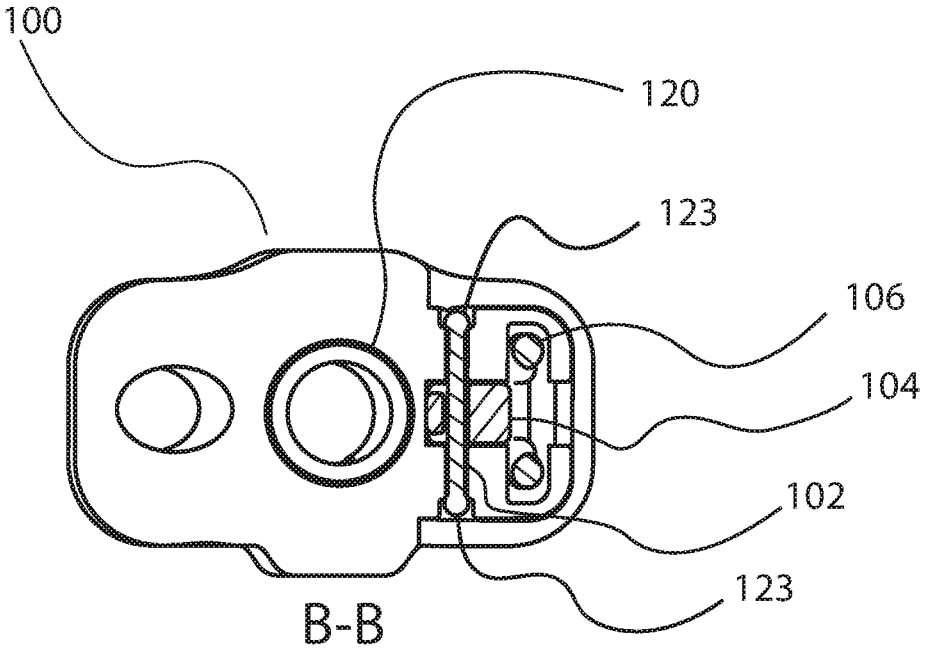
FIG. 4B is a section view taken along section lines B-B of FIG. 3, showing the tension based resilient element when the locking element is in the unlocked position.

FIG. 4B shows a cross sections of embodiment 100 of the invention taken at section line B-B of FIG. 3 in the unlocked position.

FIG. 4A shows the embodiment 100 in its locked position. With tension based elastic resilient element 102 in its deformed state. The tension based elastic resilient element 102 is held in place by attachment points 123, these could be but are not limited to elements such as crimps, or knots.

FIG. 4B shows the embodiment 100 in its unlocked position, with the tension based elastic resilient element 102 in its undeformed, or lesser deformed state.

Operation:

Attachment end 117 of safety release member 114 is locked by the locking clip 106 being held in place by the downward pivoting locking element 104 which is unable to rotate, as the actuating retaining cuff 108 blocks its path at point 110. Once the user actuates the actuating retaining cuff 108 in direction 116 the downward pivoting locking element 104 is forced to rotate about pivot point 112 by the tension based elastic resilient element 102, ejecting the locking clip 106.

Variations:

It will be understood that the elastic element could be tension based, compression based, or torsion based, to aid in actions such as release, resilient, or locking of a kitesurfing safety device by actuating a pivoting locking element.

It will be understood that the elastic element could be an element that deforms to create a force such as but not limited to a section of shock cord, a torsion spring, or a spring.

It will be understood that the pivoting element could pivot downward or pivots upward. It will be understood that the pivoting element could pivots about a vertical axis or a horizontal axis.

It will be understood that the actuating release cuff is pushed away from the user to actuate the system, pulled towards the user to actuate the system or rotated by the user to actuate the system.

It will be understood that the elastic element could actuate the pivoting locking element indirectly by actuating an intervening secondary mechanism, such as a gear or pin, which in turn rotates the pivoting locking element.

Figure 5:
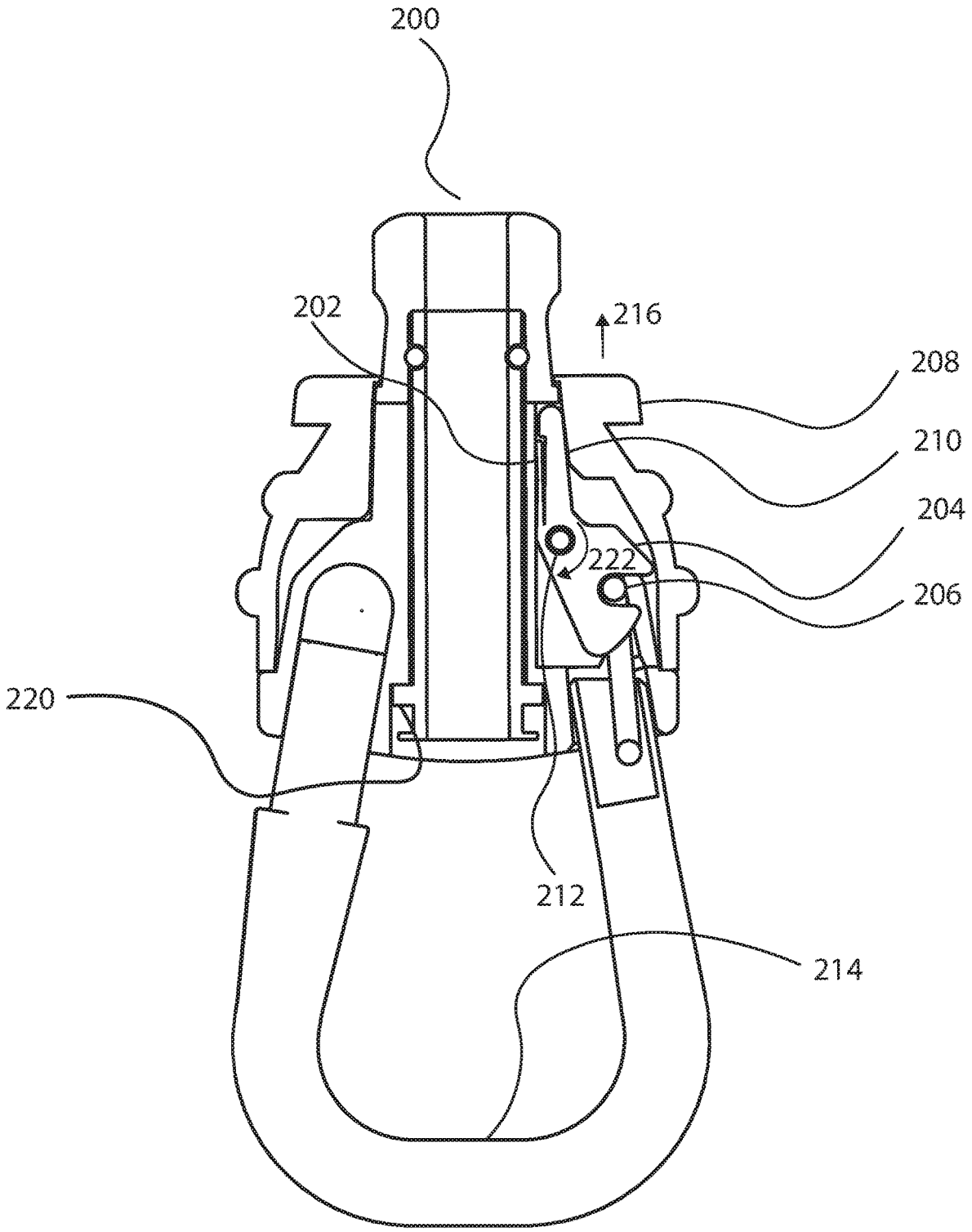
FIG. 5 is a top plan view, in section, of a second embodiment of safety release mechanism, with a torsional based resilient element and the locking element in the locked position securing the safety release member to the body of the safety release mechanism.

FIG. 5: FIG. 5 shows a cross section of embodiment 200 of the invention using a torsion based elastic resilient element 202 in its locked position. This embodiment functions the same as embodiment 100 with the exception that the elastic resilient element utilizes a torsion based resilient element 202 to apply the rotational force 222 to the downward pivoting locking element 204. The torsion based resilient element 202 could be but is not limited to a torsion spring, or a cantilever spring.

Figure 6:
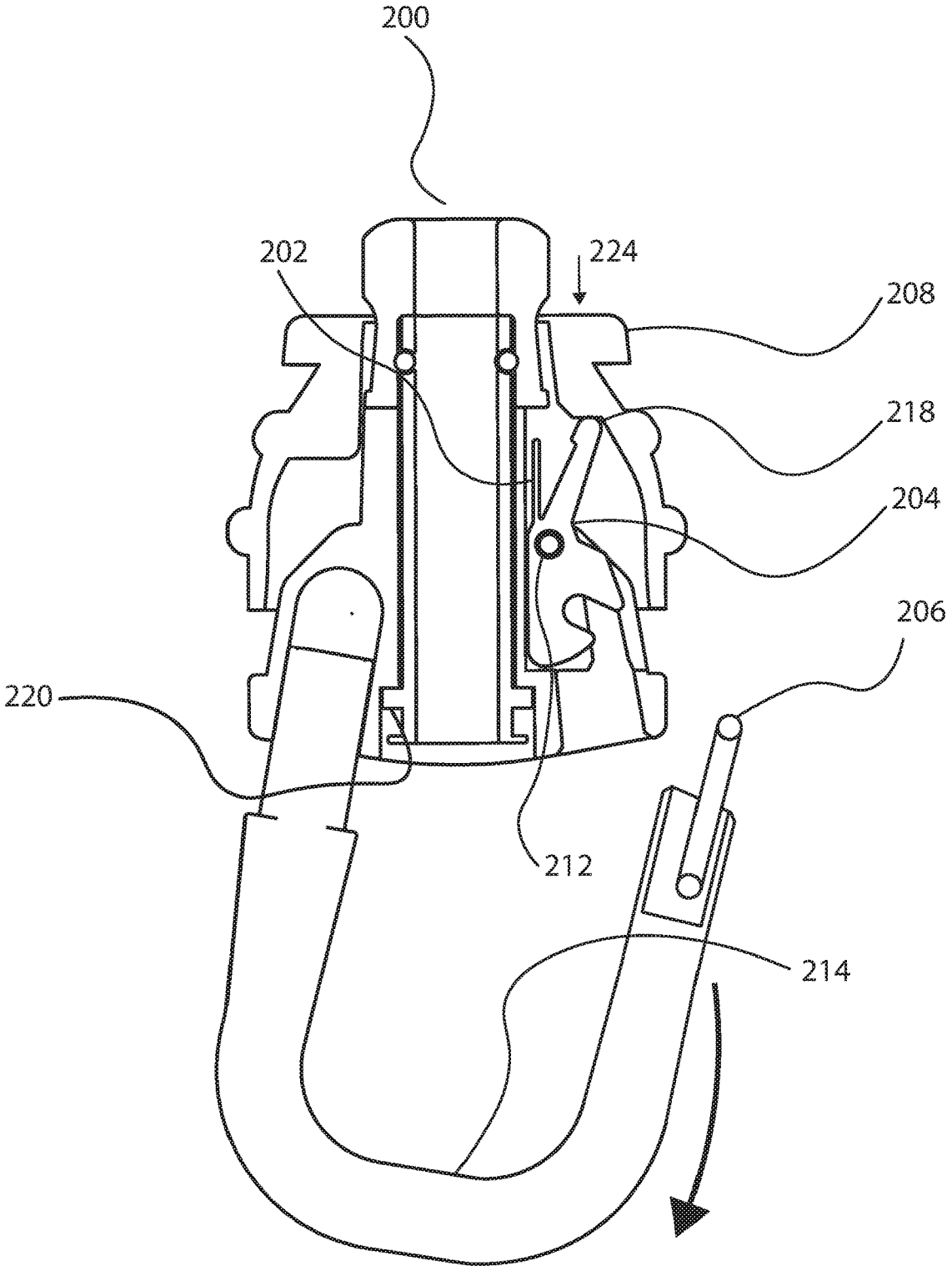
FIG. 6 is a top plan view, in section, of the second embodiment of safety release mechanism shown in FIG. 5, with the torsional based resilient element and the locking element in the unlocked position releasing the safety release member.

FIG. 6: FIG. 6 shows a cross section of embodiment 200 of the invention using a torsion based elastic resilient element 202 in its open position. This embodiment functions the same as embodiment 100 with the exception that the elastic resilient element utilizes a torsion based resilient element 202 to hold the downward pivoting locking element 204 against the actuating retaining cuff 208 at point 218 to lock the device in its open position.

Figure 7:
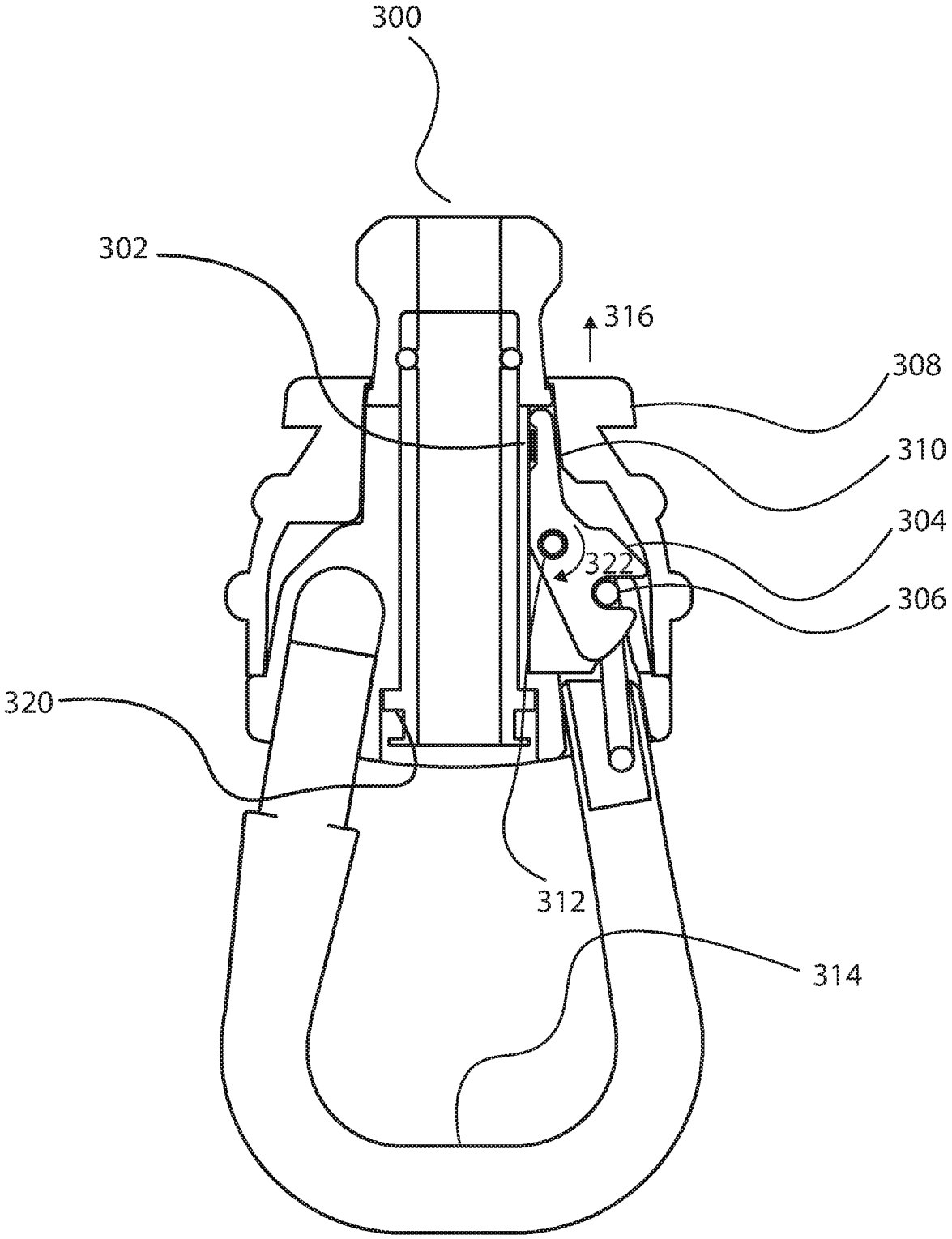
FIG. 7 is a top plan view, in section, of a third embodiment of safety release mechanism, with a compression based resilient element and the locking element in the locked position securing the safety release member to the body of the safety release mechanism.

FIG. 7: FIG. 7 shows a cross section of embodiment 300 of the invention using a compression based elastic resilient element 302 in its locked position. This embodiment functions the same as embodiment 100 with the exception that the elastic resilient element utilizes a compression based resilient element 302 to apply the rotational force 322 to the downward pivoting locking element 304. The torsion based resilient element 302 could be but is not limited to a spring, or a compressive structure.

Figure 8:
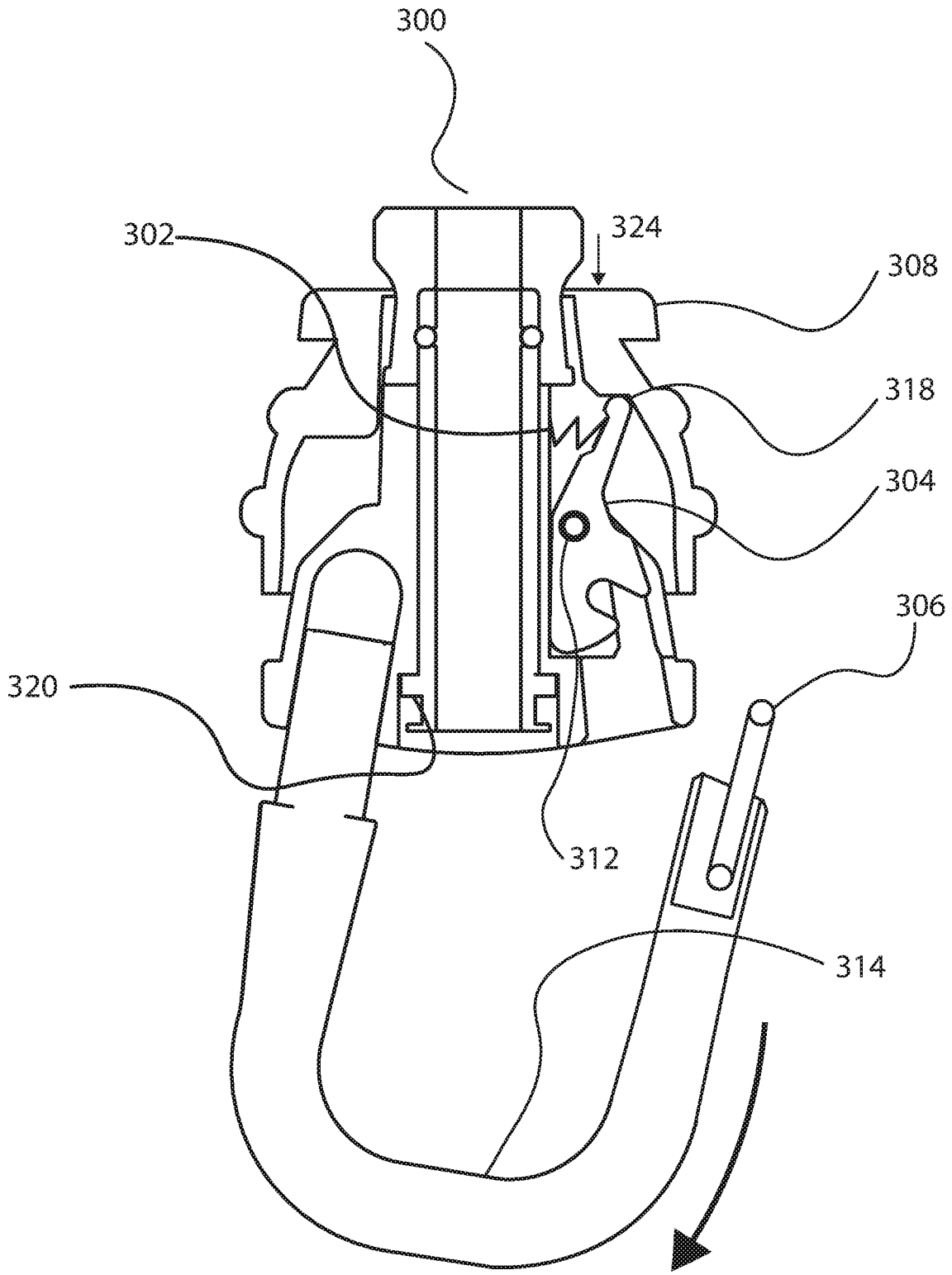
FIG. 8 is a top plan view, in section, of the third embodiment of safety release mechanism shown in FIG. 7, with the compression based resilient element and the locking element in the unlocked position releasing the safety release member.

FIG. 8: FIG. 8 shows a cross section of embodiment 300 of the invention using a compression based elastic resilient element 302 in its open position. This embodiment functions the same as embodiment 100 with the exception that the elastic resilient element utilizes a compression based resilient element 302 to hold the downward pivoting locking element 304 against the actuating retaining cuff 308 at point 318 to lock the device in its open position.

Figure 9:
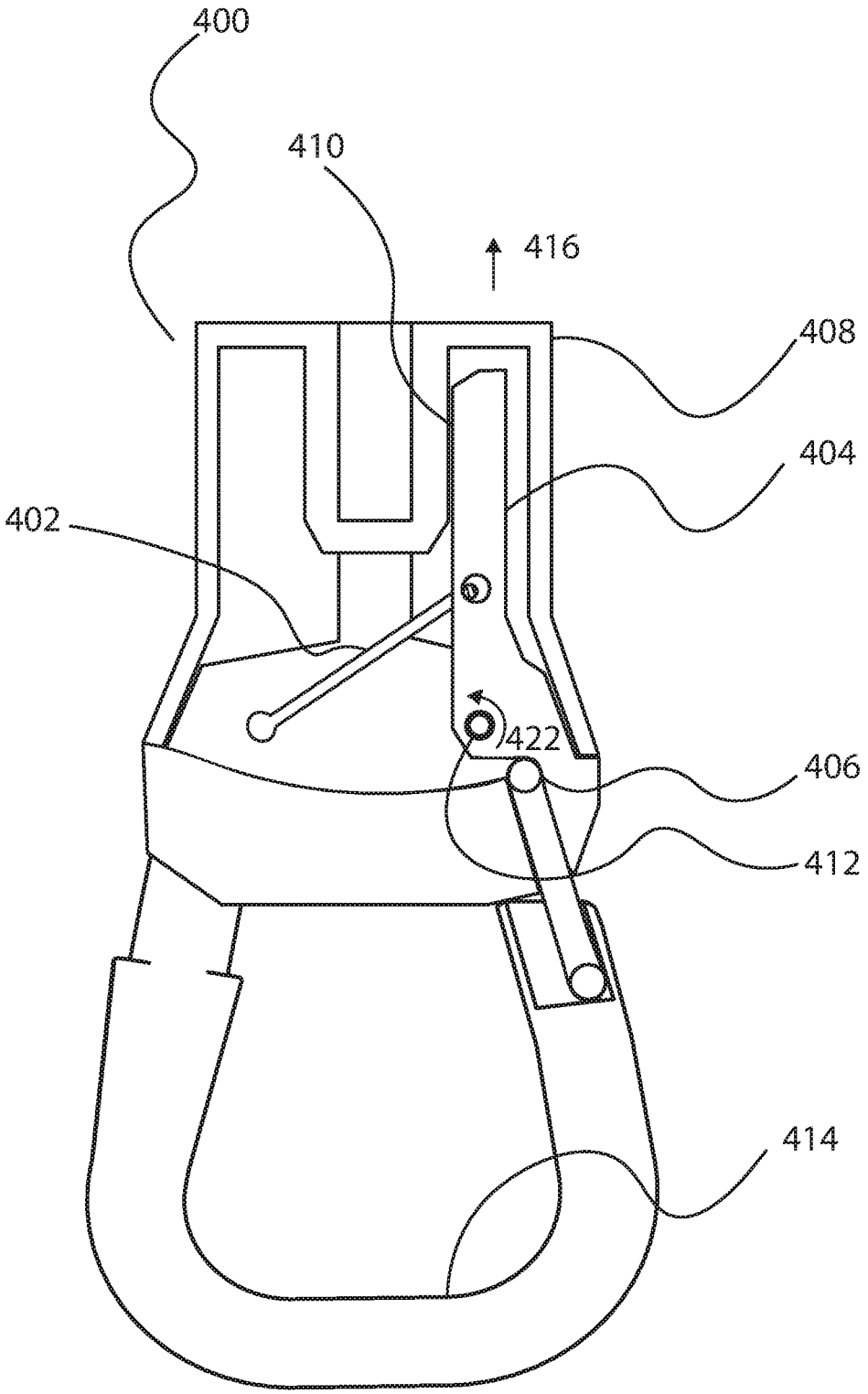
FIG. 9 is a top plan view, in section, of a fourth embodiment of safety release mechanism, with a torsion based resilient element and a upwardly pivoting locking element in the locked position securing the safety release member to the body of the safety release mechanism.

FIG. 9: FIG. 9 shows a cross section of embodiment 400 of the invention using a tension based resilient element 402 and an upward pivoting locking element 404 in its locked position. The invention is locked by the locking clip 406 being held in place by the upward pivoting locking element 404 which is unable to rotate, as the actuating retaining cuff 408 blocks its path at point 410. In this position, the tension based resilient element 402 is elastically deformed, and is applying a rotational force in direction 422 to the upward pivoting element 404.

The user is attached to the invention at user safety release member 414 by an attachment device such as but not limited to a harness using hook, ball, or rope.

Once the user actuates the actuating retaining cuff 408 in direction 416 the upward pivoting locking element 404 is forced to rotate about pivot point 412 by the tension based elastic resilient element 402, ejecting the locking clip 406.

Figure 10:
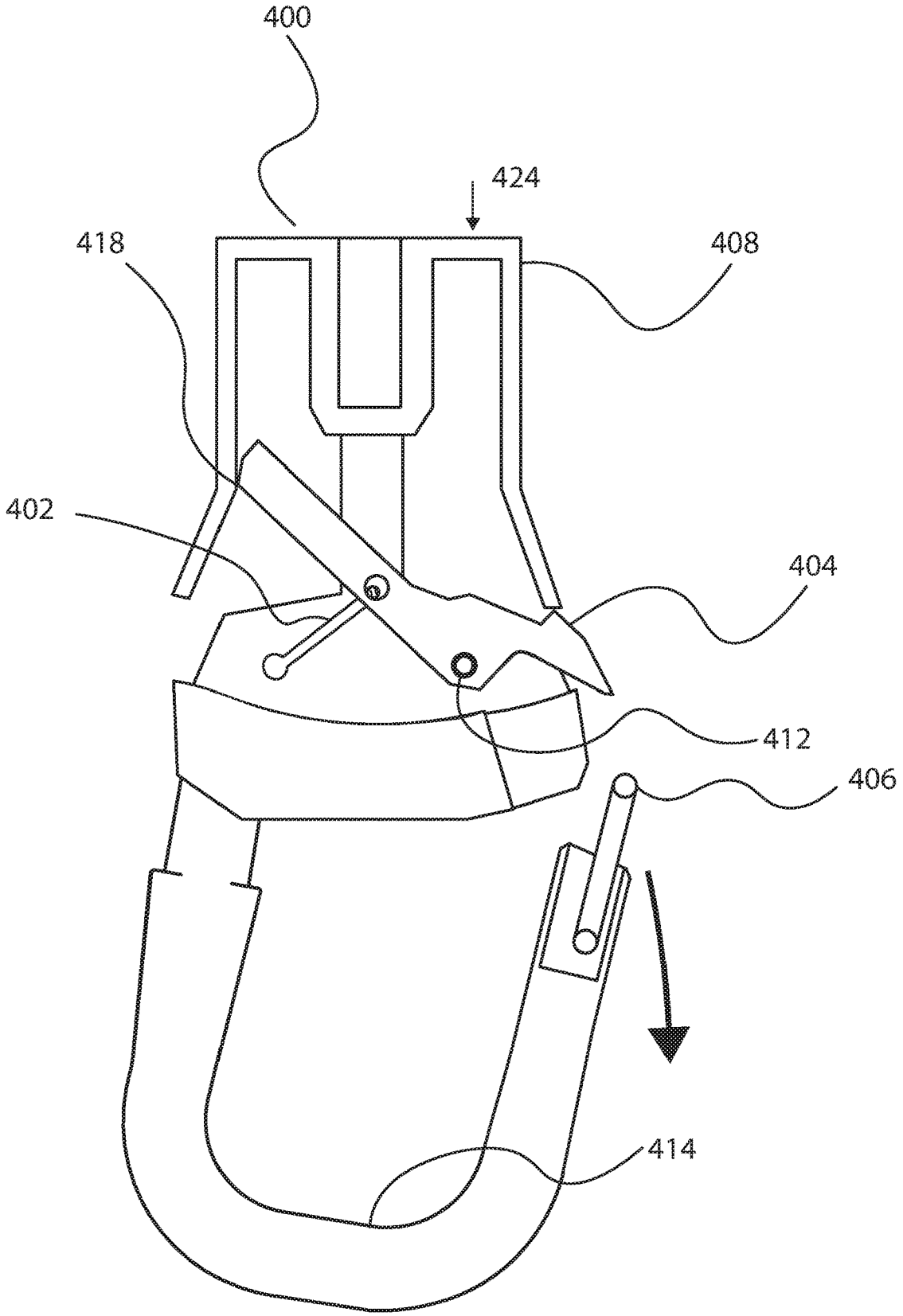
FIG. 10 is a top plan view, in section, of the fourth embodiment of safety release mechanism shown in FIG. 9, with the torsion based resilient element and the upwardly pivoting locking element in the unlocked position releasing the safety release member.

FIG. 10: FIG. 10 shows a cross section of embodiment 400 of the invention using a tension based resilient element 402 and an upward pivoting locking element 404 in its unlocked position.

In the unlocked position, the user's attachment device is no longer attached at the user safety release member 414. And the actuating retaining cuff 408 is locked in its open position by the upward pivoting locking element 404 at point 418. The tension based elastic resilient element 402 is either in an undeformed state, or at a lesser deformed state than in its locked position.

To lock the device again. The locking clip 406 is put in place, and the upward pivoting locking element 404 is pulled into place by the user, rotating it about pivot point 402. This allows the actuating retaining cuff 408 to return to the locked position moving in the direction 424. This motion also returns the tension based elastic resilient element 402 to its deformed state.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A safety release mechanism for kite surfing, comprising:

a body having a connection for connecting the body to a kite surfing assembly;

a safety release member by which a kite surfer is attached to the body, the safety release member having an attachment end;

a locking element for securing the attachment end of the safety release member to the body, the locking element having a locked position and an unlocked position;

a release for the locking element, such that the locking element is unable to move from the locked position to the unlocked position until the release is activated; and a resilient element urging the locking element into the unlocked position, such that upon activation of the release for the locking element, the resilient element moves the locking element to the unlocked position thereby releasing the attachment end of the safety release member;

wherein the locking element release is a cover overlying the locking element, such that the locking element is unable to move from the locked position to the unlocked position as long as the cover is in position.

2. The safety release mechanism of claim 1, wherein the resilient element is a tension based resilient element.

3. The safety release mechanism of claim 1, wherein the resilient element is a compression based resilient element.

4. The safety release mechanism of claim 1, wherein the resilient element is a torsion based resilient element.

5. The safety release mechanism of claim 1, wherein the safety release member has a first end anchored to the body.

6. The safety release mechanism of claim 5, wherein the safety release member is pivotally attached to the body for pivotal movement between an operative position and a release position.

* * * * *